US006335735B1

(12) United States Patent
Denda et al.

(10) Patent No.: US 6,335,735 B1
(45) Date of Patent: Jan. 1, 2002

(54) DYNAMIC IMAGE CORRECTION METHOD AND DYNAMIC IMAGE CORRECTION CIRCUIT FOR DISPLAY DEVICE

(75) Inventors: Hayato Denda; Masamichi Nakajima; Masayuki Kobayashi, all of Kanagawa-ken (JP)

(73) Assignee: Fujitsu General Limited, Kawasaki (JP)

( * ) Notice: Subject to any disclaimer, the term of this patent is extended or adjusted under 35 U.S.C. 154(b) by 0 days.

(21) Appl. No.: 09/402,562

(22) PCT Filed: Apr. 1, 1998

(86) PCT No.: PCT/JP98/01503

§ 371 Date: Oct. 5, 1999

§ 102(e) Date: Oct. 5, 1999

(87) PCT Pub. No.: WO98/45831

PCT Pub. Date: Oct. 15, 1998

(30) Foreign Application Priority Data

Apr. 10, 1997 (JP) ..... 9-108279

(51) Int. Cl.[7] ..... G09G 5/10

(52) U.S. Cl. ..... 345/589; 345/590; 345/592; 345/618

(58) Field of Search ..... 345/147, 148, 345/149, 112, 12, 63, 60, 77, 89, 426, 432, 37, 418, 204, 207, 589, 590, 591, 592, 618; 340/815.55, 815.45, 815.56, 815.75

(56) References Cited

U.S. PATENT DOCUMENTS 4,769,713 A * 9/1988 Yasui ..... 348/791
5,543,819 A * 8/1996 Farwell et al. ..... 345/150
5,686,800 A * 11/1997 Kim ..... 315/371
5,900,886 A * 5/1999 Shay ..... 345/147
5,959,619 A * 9/1999 Kameyama et al. ..... 345/204
6,064,359 A * 5/2000 Lin et al. ..... 345/89
6,127,991 A * 10/2000 Uehara et al. ..... 345/60
6,175,355 B1 * 1/2001 Reddy ..... 345/148
6,208,467 B1 * 3/2001 Naka et al. ..... 359/618
6,249,268 B1 * 6/2001 Tachibana et al. ..... 345/89

FOREIGN PATENT DOCUMENTS

JP 5-351000 12/1994
JP 8-123355 5/1996

* cited by examiner

*Primary Examiner*—Matthew Luu
*Assistant Examiner*—Thu-Thao Havan
(74) *Attorney, Agent, or Firm*—Flynn, Thiel, Boutell & Tanis, P.C.

(57) ABSTRACT

A display device which displays a multilevel gradation image by dividing a frame into a plurality of subfields in respect of time and by allowing the subfields corresponding to the luminance levels of the input image signals to emit light, comprising a motion vector detection unit 10 which detects the motion vector which expresses the motion of a block from one frame to the next, a high speed dynamic image correction unit 14 and a law speed dynamic image correction unit 16 which correct the input image signal by dynamic image correcting means which are suitable for the respective cases when the value of the detected motion vector is larger than a preset value S and when it is smaller than the preset value S and output the corrected input image signal, and a switching unit 18 which elects either the output signal of the high speed dynamic image correction unit 14 or the output signal of the law speed dynamic image correction unit 16 to output the selected signal to the display in accordance with whether or not the value of the detected motion vector is larger than the preset value S. As a result, both the high speed dynamic image part and the low speed dynamic image part of the image can be optimally corrected.

4 Claims, 6 Drawing Sheets

DYNAMIC IMAGE CORRECTION METHOD AND DYNAMIC IMAGE CORRECTION CIRCUIT FOR DISPLAY DEVICE

FIELD OF THE INVENTION

The present invention relates to a dynamic image correction method and dynamic image correction circuit of display device, wherein one frame is divided into a plurality of subfields (or subframes) on time-sharing basis and the subfields are made to emit light according to luminance levels of input signals for producing multi-gradation image.

BACKGROUND ART

Display devices incorporating PDP (Plasma Display Panel) and LCD (Liquid Crystal Display) are now attracting the attention of those who concerned as thin and lightweight display device. This drive method of the PDP is entirely different from that of conventional CRT in that the PDP is directly driven by input of digitized video signal. Thus, the luminance and gradation of the light emitted from panel surface are dependent on the number of bits of signal to be processed.

The PDP can be divided into two types, namely, AC-type and DC-types differing in basic characteristic. As for the AC-type PDP, sufficient characteristics can be obtained as to luminance and service life, while availability of only up to 64 gradations has been reported on trial manufacture basis, but a method for enabling 256 gradations by address display separation method in the future has already been proposed.

Drive sequence and drive waveform of the PDP to be used in this method, for example in the case of 8 bits and 256 gradations, are as shown in FIGS. 1(*a*) and (*b*) respectively.

In FIG. 1(*a*), one frame comprises 8 subfields SF1, SF2, SF3, SF4, SF5, SF6, SF7 and SF8 having luminance ratios of 1, 2, 4, 8, 16, 32, 64, 128, and display of 256 gradations is available by Combining the luminances of 8 images.

In FIG. 1(*b*), each subfield comprises an address period for writing the data for 1 image and a sustain period for determining the luminance level of the subfield. During the address period, initial wall charge is formed simultaneously for each of the pixels of all the images, and then sustain pulse is given to all the images for display. The brightness of the subfield is proportional to the number of the sustain pulse and set to a predetermined luminance. The 256-gradation display is made available in this way.

When displaying a dynamic image by using an address display separation type display device as is described previously, input video signal (original signal) is a discrete signal, which is sampled for each frame (or field), thereby giving rise to a problem such as degradation of picture quality resulting from the visual disagreement in the direction of the movement of the dynamic image and the presence of the level not in accordance with the original signal. The dynamic image correction according to the prior art has been made by applying only one predetermined dynamic image correction method on the basis of the input video signal, regardless of the rate of the movement of block during one frame or during a plurality of frames. Here, one block means an area of image formed with one or a plurality of picture elements, e.g., 2×2 picture elements.

According to the case of the prior art described above, however, the dynamic image is corrected by using only one same dynamic image correction method regardless of rapid moving part of dynamic image (hereinafter referred to as "rapid moving dynamic image part") and slow moving part of dynamic image (hereinafter referred to as "slow moving dynamic image part"), thereby causing a problem such that, when the dynamic image correction method is adapted for the rapid moving dynamic image part, correction for the slow moving dynamic image part becomes insufficient and vice versa.

The present invention, devised, in consideration of the problem of the prior art, for the display device having one frame divided into a plurality of subfields which emit light according to luminance level of input video signal for displaying multi-gradation image, is designed to provide a dynamic image correction method and a dynamic image correction circuit capable of effecting optimum dynamic image correction for both the rapid moving dynamic image part and the slow moving dynamic image part.

DISCLOSURE OF THE INVENTION

In the dynamic image correction method according to the present invention, for display device wherein one frame is divided into a plurality of subfields which emit light according to luminance level of input video signal for the display of multi-gradation image, the moving vector of the block during one frame or the blocks during a plurality of frames is or are detected, and, depending on whether the value of detected moving vector is larger than the preset value S or not, either a signal obtained by correcting input video signal by the rapid moving dynamic image correction means or a signal obtained by correcting input video signal by the slow moving dynamic image correction means is selectively output to the display device.

When the value of the moving vector detected on the basis of input video signal is larger than the preset value S, the input video signal is corrected by the rapid moving dynamic image correction means for output to the display device, while when the value of the detected moving vector is smaller than the preset value S, the input video signal is corrected by the slow moving dynamic image correction means for output to the display device, whereby an optimum dynamic image correction can be accomplished for both the rapid moving dynamic image part and slow moving dynamic image part to be displayed on the display device.

Further, according to the dynamic image correction method of the present invention, the rapid moving dynamic image correction means not only selects the light emitted from corresponding subfields among n number of subfields, SFn, SF(n−1), . . . SF1, which constitute one frame, according to the luminance level of input video signal but also corrects the display positions of the n number of subfields SFn~SF1 in each frame of input video signal depending on the value of detected moving vector, while the slow moving dynamic image correction means selects the light emitted from the subfields SF(n−1), . . . SF1 and SF1*a*, SF1*a* being adjacent to SF1 and having a luminance ratio equivalent to that of SF1, which constitute one frame, only when the luminance levels of input video signal has varied from $2^{(n-1)}-1$ to $2^{(n-1)}$, but selects the light emitted from the corresponding subfields among n number of subfields, SFn~SF1 not including the subfield SF1*a* with respect to the luminance levels other than those described previously. Therefore, when the value of detected moving vector is larger than the preset value S, the display positions of the subfields SFn~SF1 can be made to match with the visual path of the eye of a person watching the dynamic image. On the other hand, when the value of detected moving vector is smaller than the preset value S, the light emitted from the subfields, SF(n−1)~SF1 and SF1*a* (e.g., SF3, SF2, SF1 and SF1*a*) is selected by the slow moving dynamic image correction means with respect to luminance level at $2^{(n-1)}$ (e.g., 8 when n=4) resulting when a luminance level has varied slightly from $2^{(n-1)}-1$ (e.g., 7) to a luminance level at $2^{(n-1)}$(e.g., 8), thereby eliminating large variation of luminance.

The dynamic image correction circuit of present invention, incorporated into the display device wherein one frame is divided into a plurality of subfields on time-sharing basis for emitting light from the subfields according to luminance level of input video signal to display multi-gradation image, comprises a moving vector detector for detecting the moving vector of the block during one frame or moving vector of the block during a plurality of frames, a rapid moving dynamic image corrector for correcting for output an input video signal by using a proper dynamic image correction means when the value of the moving vector detected by the moving vector detector is larger than preset value S, a slow moving dynamic image corrector for correcting for output an input video signal by using a proper dynamic image correction means and a discriminating selector for discriminating an output signal from the rapid moving dynamic image corrector from an output signal from the slow moving dynamic image corrector for output to the display device depending on whether the value of the moving vector detected by the moving vector detector is larger or smaller than the preset value S. The discriminating selector outputs the input video signal corrected by the rapid moving dynamic image corrector to the display device when the value of detected moving vector is larger than the preset value S and outputs the input video signal corrected by the slow moving dynamic image corrector to the display device when the value of detected moving vector is smaller than the preset value S, so that an optimum dynamic image correction can be accomplished for both the rapid moving dynamic image part and the slow moving dynamic image part to be displayed on the display device.

The dynamic image correction circuit according to the present invention is designed so that the rapid moving dynamic image corrector not only selects the light emitted from corresponding subfields among n number of subfields SFn~SF1 constituting one frame and having luminance ratios $2^{(n-1)}$ through $2^{0(=n-n)}$ according to the luminance level of the input video signal but also corrects display positions of n number of subfields SFn~SF1 for each frame of input video signal depending on the value of moving vector detected by the moving vector detector, while the slow moving dynamic image corrector selects the light emitted from the subfields, SF(n−1), . . . SF1, SF1*a*, constituting one frame and having luminance ratios $2^{(n-1)}$, $2^{(n-2)}$, . . . $2^{0(=n-n)}$, only when the luminance level of input video signal has varied from $2^{(n-1)}-1$ to $2^{(n-1)}$ and also selects the light emitted from corresponding subfields among n number of subfields, SFn~SF1, not including subfield SF1*a*, as to the luminance level other than those prescribed previously.

Therefore, when the value of detected moving vector is larger than the preset value S, the display positions of the subfields, SFn~SF1 can be made to match with the visual path of the eye of a person watching the dynamic image by using the rapid moving dynamic image corrector. On the other hand, when the value of detected moving vector is smaller than the preset value S, the light emitted from the subfields, SF(n−1)~SF1 and SF1*a* (e.g., SF3, SF2, SF1 and SF1*a*) is selected by the slow moving dynamic image corrector with respect to the luminance level at $2^{(n-1)}$ resulting when the luminance level has slightly varied from a luminance level at $2^{(n-1)}-1$ (e.g., 7 when n=4) to $2^{(n-1)}$ (e.g., 8), thereby eliminating large variation of luminance.

BEST MODE FOR CARRYING OUT THE INVENTION

The present invention will be described in detail referring to accompanying drawings.

Figure 1:
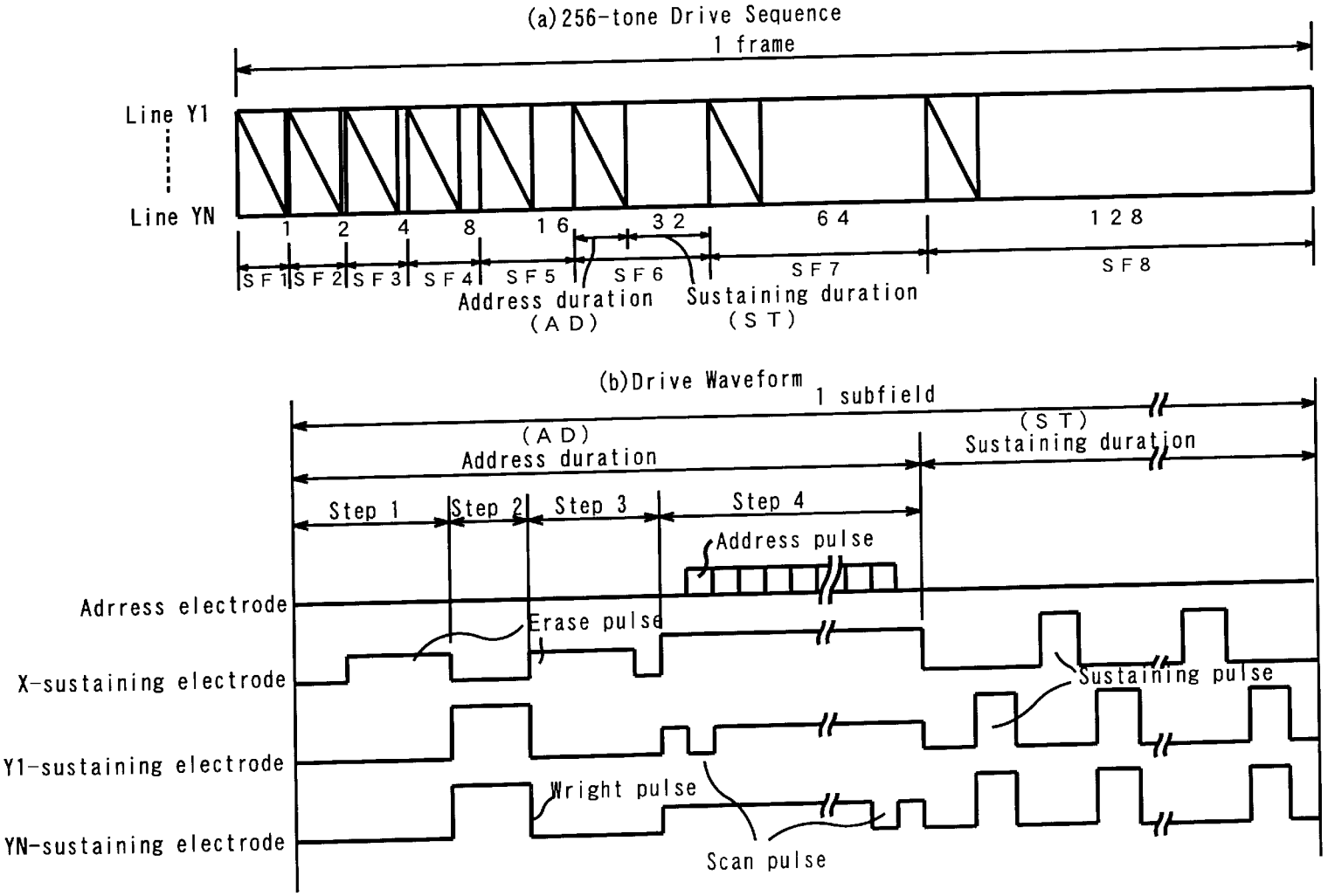
FIG. 1 illustrates the address display separation type drive method, wherein (a) is a diagram illustrating the drive sequence for 256-gradation image, while (b) is a diagram illustrating drive waveform.
Figure 2:
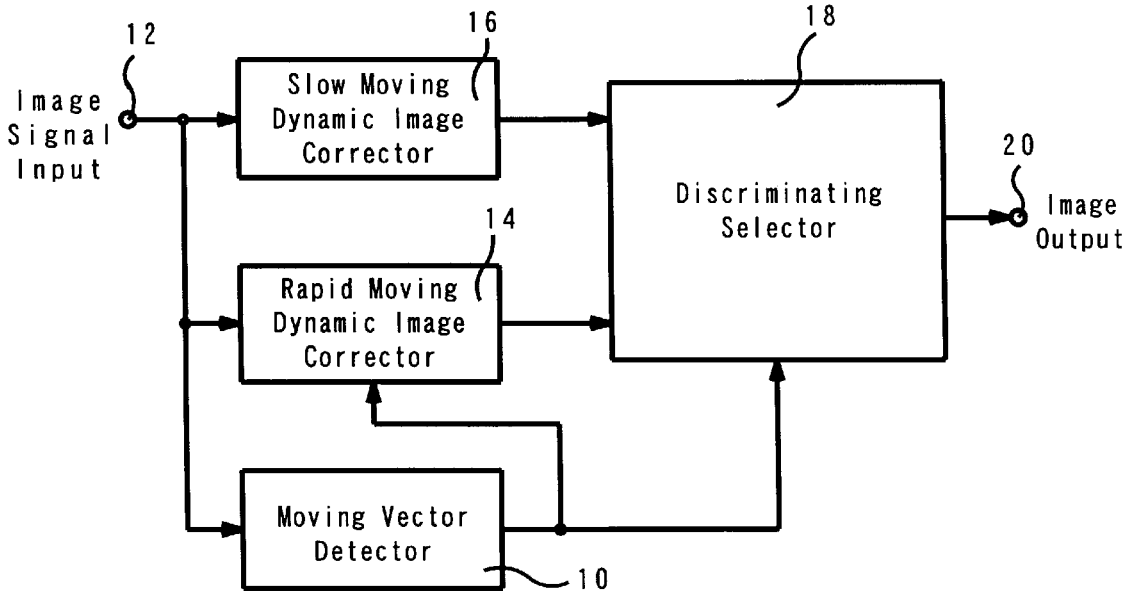
FIG. 2 shows the dynamic image correction circuit for practicing the dynamic image correction method for display device as an embodiment of the invention.
Figure 3:
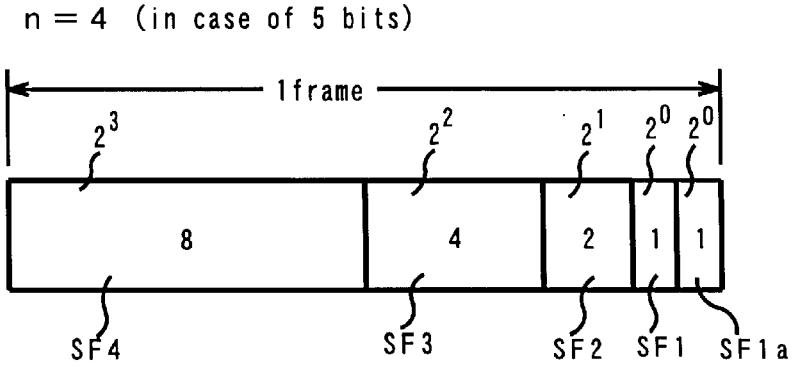
FIG. 3 is a diagram illustrating the drive sequence of the address display separation type drive method when n=4 is given for convenience in illustrating the dynamic image correcting function of the slow moving dynamic image corrector shown in FIG. 2.

FIG. 2 shows an embodiment of the dynamic image correction circuit for carrying out the dynamic image correction method for the display device according to the present invention.

In FIG. 2, reference numeral 10 denotes the moving vector detector, which detects and outputs the moving vector (direction and amount of movement) of the block (e.g., 2×2 picture elements) during one frame or the blocks during a plurality of frames on the basis of the video signal input to input terminal 12. For instance, on the bases of the video signals of the present frame and preceding frame, the moving vector of the block to be corrected for the image of the present frame of the PDP is detected and output by the moving vector detector.

Reference numeral 14 denotes the rapid moving dynamic image corrector, which corrects the video signal input to the input terminal 12 by proper dynamic image correction means and outputs the corrected video signal, when the value of the moving vector detected by the moving vector detector 10 is larger (e.g., equal to or larger than S) than the preset value S (e.g., 2 dots/frame).

Reference numeral 16 denotes the slow moving dynamic image corrector, which corrects the video signal input to the input terminal 12 by proper dynamic image correction means and outputs the corrected video signal, when the value of the moving vector detected by the moving vector detector 10 is smaller than the preset value S (e.g., S or less).

Reference numeral 18 denotes the discriminating selector, which selectively outputs the signal output from the rapid moving dynamic image corrector 14 or the signal output from the slow moving dynamic image corrector 16 to output terminal 20, depending on whether the value of the moving vector detected by the moving vector detector 10 is larger or smaller than the preset value S.

The rapid moving dynamic image corrector 14 has a construction, for example, substantially the same as that of corresponding rapid moving dynamic image corrector for the dynamic image correction method and the dynamic image corrector according to (Japanese Patent Application Publication No. H7-317508(317508/1995)), the application therefor having already been filed by the present applicant. That is, the rapid moving dynamic image corrector 14, comprising a data conversion circuit for converting input n-bit video signal into display data of subfields SFn~SF1 and a ROM (read-only memory) for outputting the data representing the corrected display positions of the subfields SFn~SF1 with address represented by the detected moving vector, not only selects the light emitted from the corresponding subfields among the n number of subfields SFn~SF1 according to the luminance level of video signal input to the input terminal 12 but also outputs the signal corrected as to the display positions of subfields SFn~SF1 of each frame of input video signal according to the value of the moving vector detected by the moving vector detector 10.

The slow moving dynamic image corrector 16 has a construction, for example, substantially the same as that of the corresponding slow moving dynamic image corrector incorporated into the display device drive method according to Japanese Patent Application Publication No. H7-108191 (108191/1995) which has been filed by the present inventor. That is, the slow moving dynamic image corrector 16 is designed to select the light emitted from n number of subfields, SF(n−1), SF(n−2), . . . SF1 and adjacent SF1*a*, composing one frame and having luminance ratios $2^{(n-1)}$, $2^{(n-2)}$, . . . $2^{0(=n-n)}$, only when the luminance level of the video signal, which has been input to the terminal 12, has varied from $2^{(n-1)}-1$ to $2^{(n-1)}$, and also selects the light emitted from the corresponding subfields among n number of subfields, SFn~SF1, not including the subfield SF1*a*, with respect to the luminance level other than that described previously.

Next, the functions of the components shown in FIG. 2 will be described referring to FIGS. 3 through 7.

(1) First, referring to FIGS. 4 and 5, the corrective function for the rapid moving dynamic image, when the value of the moving vector detected by the moving vector detector 10 is larger than the present value S (e.g., 2 dots/frame), will be explained.

Figure 7:
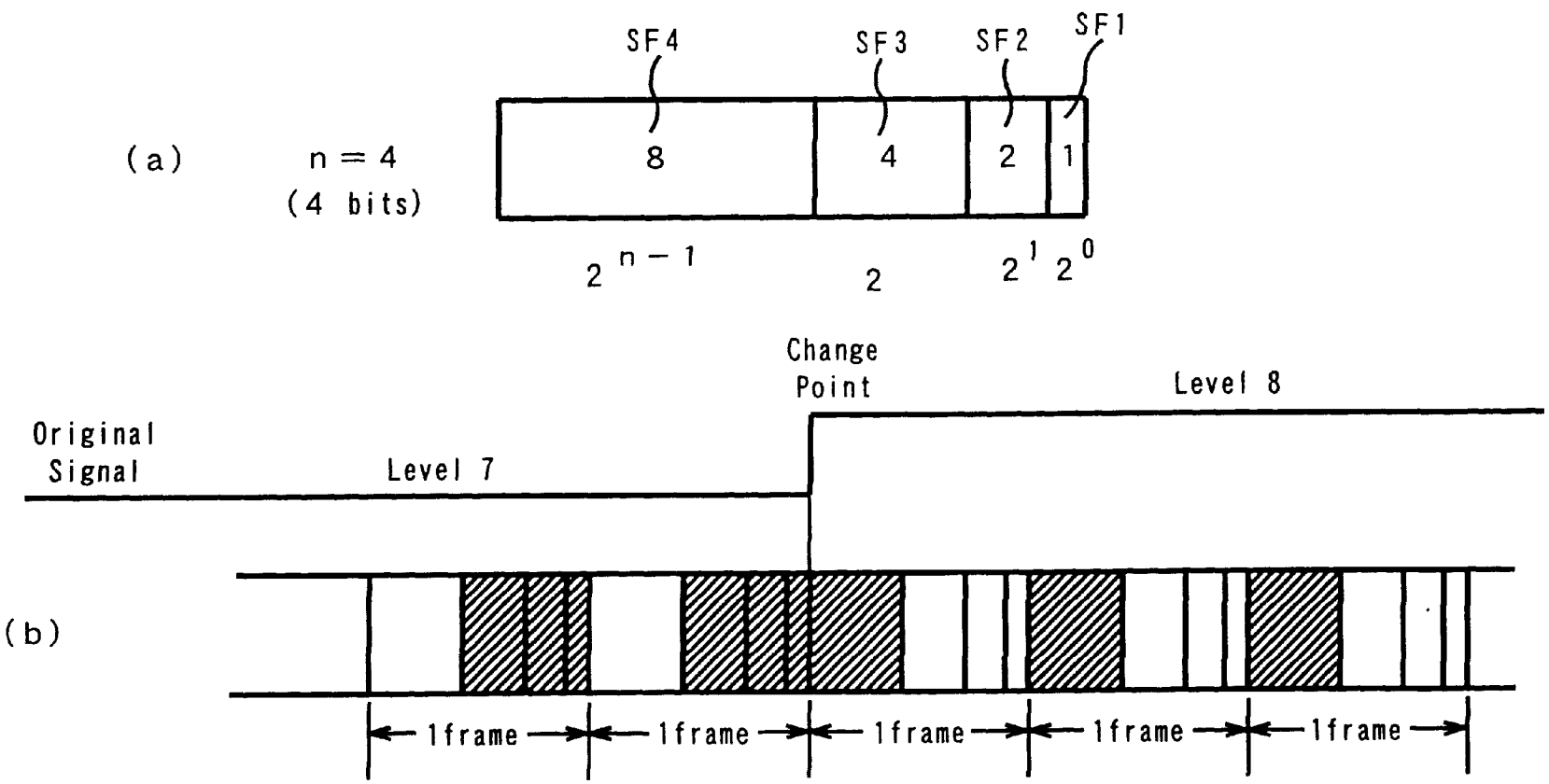
FIG. 7 shows a comparative embodiment to that shown in FIG. 6, wherein (a) illustrates the drive sequence of the subfield method applied to a case of 16-gradation display, while (b) schematically illustrates a case where slow moving dynamic image correction is not applied.

For convenience of explanation, as shown in FIG. 7(*a*), assume that one frame is composed of 4 subfields (n=4) SF4, SF3, SF2 and SF1 with luminance ratios of $2^3$, $2^2$, $2^1$ and $2^0$, and the block of dynamic image relating to input video signal with luminance level 15 is to move in a predetermined direction at a rate of 5 dots (or 5 picture elements) per frame. Since the value (5 dots/frame) of the moving vector detected by the moving vector detector 10 is larger than the preset value S (e.g., 2 dots/frame), the signal output from the rapid moving dynamic image corrector 14 through the discriminating selector 18 is delivered to the display device (e.g., PDP) through the output terminal 20.

Figure 4:
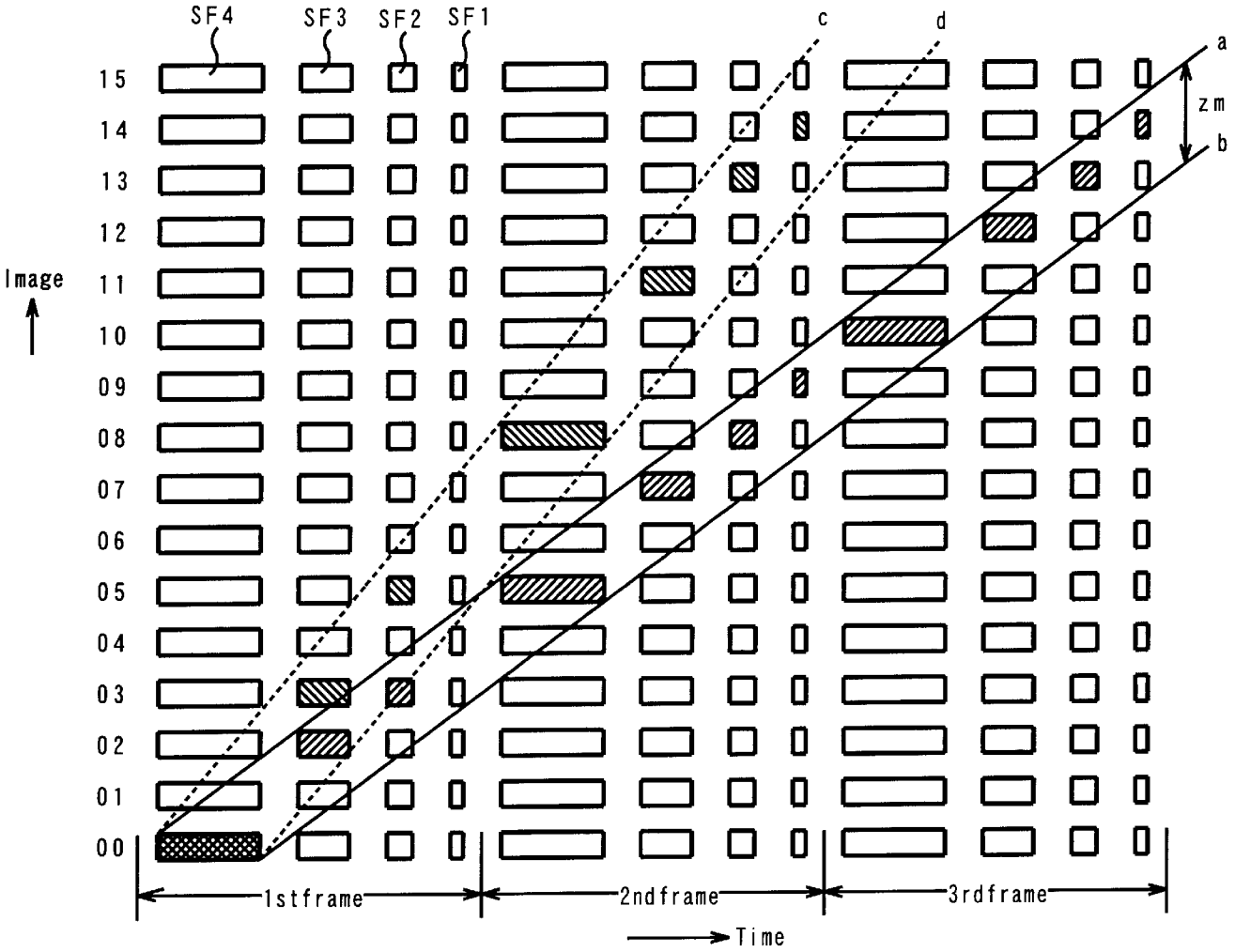
FIG. 4 schematically illustrates the dynamic image Correcting function of the rapid moving dynamic image corrector shown in FIG. 2.
Figure 5:
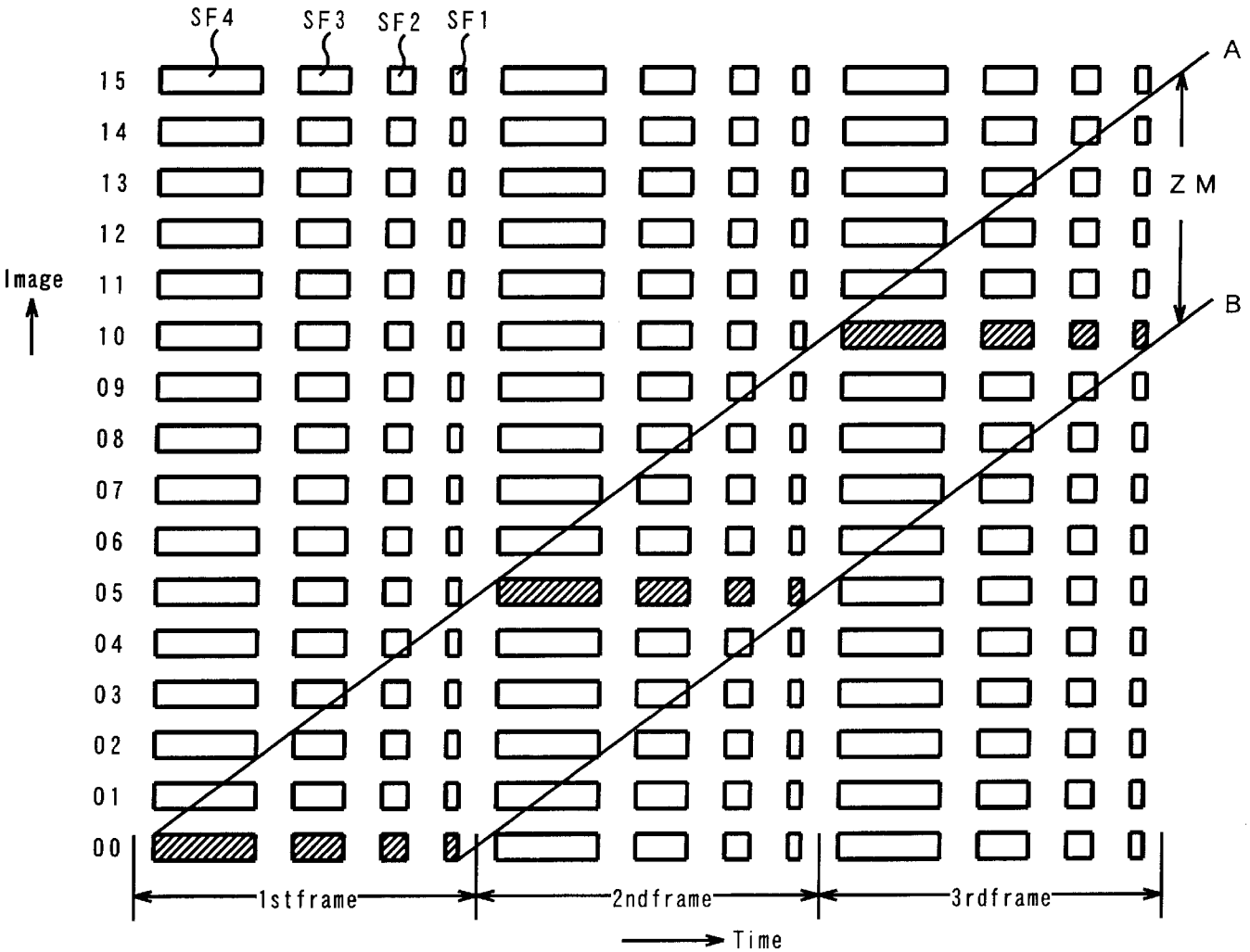
FIG. 5 shows a comparative embodiment to that shown FIG. 4 and schematically illustrates a case where rapid moving dynamic image correction is not employed.

(2) As shown in FIG. 4, the signal output from the rapid moving dynamic image corrector 14 not only makes all the subfields SF4~SF1 emit light but also generates a signal corrected so that the display positions of subfields SF4~SF1 of each frame come within the range between solid lines a and b, corresponding to the detected moving vector (5 dots/frame). That is, the signal is corrected for moving subfield SF4 by 0 dot (i.e., remains at the original position) subfield SF3 by 2 dots, subfields SF2 and SF1 by 3 dots and 4 dots respectively.

Therefore, the maximum deviation zm can be reduced to less than half the maximum deviation ZM (FIG. 5) where display position is not corrected, thereby preventing vagueness in the case of monochrome display and color divergence in the case of color display.

Further, in FIG. 4, the diagonal solid lines a and b represent the paths along which the block of dynamic image moving at a rate of 5 dots/frame is followed by the eye of a viewer, while the diagonal dotted lines represent the paths along which the block of dynamic image moving at a rate of 8 dots/frame is followed by the eye of a viewer. Further, FIG. 5 shows a comparative example, in which the dynamic image correction method is not employed (i.e., the case where subfield display position correction is not applied).

(3) Next, referring to FIGS. 6 and 7, explanation will be made as to the function in the case where the value of moving vector detected by the moving vector detector 10 is smaller than the preset value S (e.g., 2 dots/frame).

For convenience of explanation, assume that one frame is composed of 4 subfields (n=4) SF4, SF3, SF2, SF1 with luminance ratios of $2^3$, $2^2$, $2^1$, $2^0$ and an adjacent subfield SF1*a*with luminance ratio of $2^0$.

In this case, the Value of moving vector detected by the moving vector detector 10 is smaller than the preset value S, so that the signal output from the slow moving dynamic image corrector 16 through the discriminating selector 18 is delivered to display device (e.g., PDP) through the output terminal 20.

(3a) First, explanation will be made as to the effect of the invention in the case where luminance level varies from 7 to 8 as the result of error diffusion processing or the like.

Figure 6:
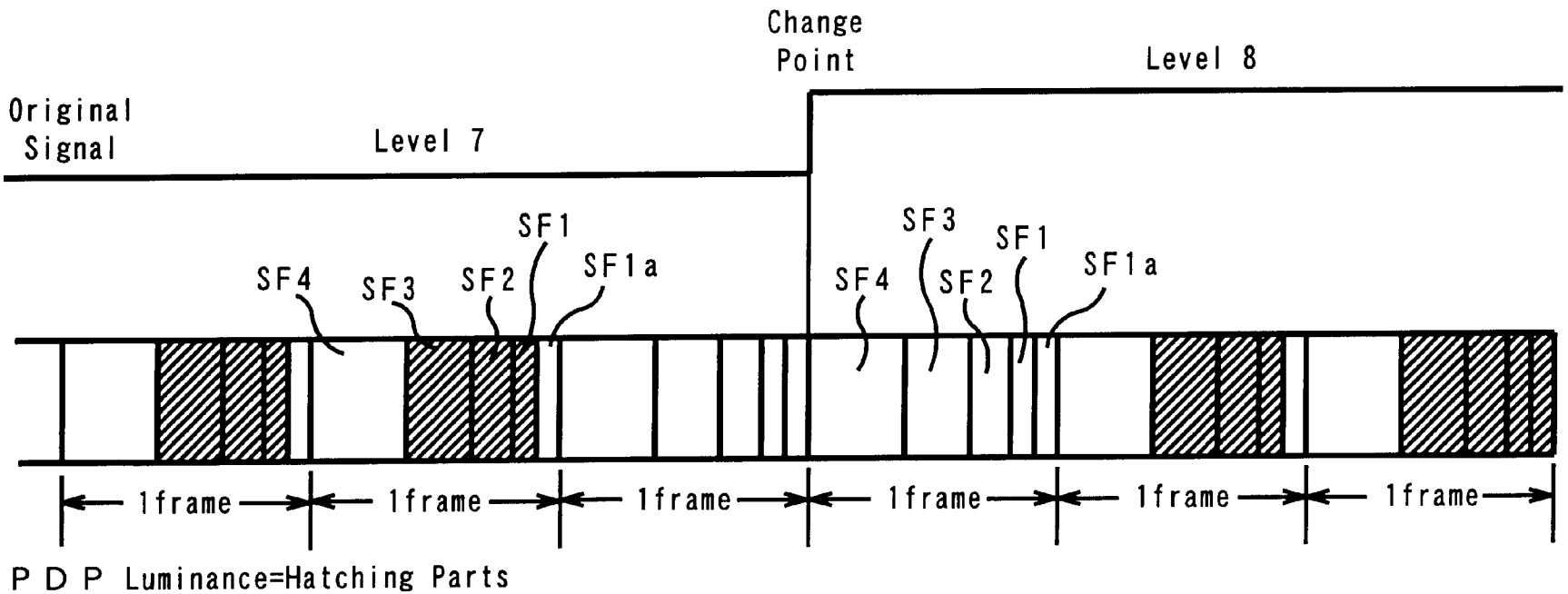
FIG. 6 schematically illustrates the dynamic image Correcting function of the slow moving dynamic image corrector shown in FIG. 2.

The signal output from the slow moving dynamic image corrector 16 with luminance level 7 becomes a signal for bringing about the emission of light by the subfields SF3, SF2 and SF1 as illustrated by the left side of the change point in FIG. 6, while the signal, with luminance level 8 that varied from luminance level 7, becomes a signal for causing the emission of light by subfields SF3, SF2, SF1 and SF1*a* as illustrated by the right side from the change point in FIG. 6.

Therefore, at the point where luminance level varies from 7 to 8, value of bit varies from 01110 to 01111 and the emission of light will not continue, so that there will be no substantial variation of luminance such as that causing disagreement with the variation of original signal, thereby preventing the degradation of picture quality.

In contrast, as shown in FIG. 7(*a*), when one frame is composed of only 4 subfields SF4~SF1 without adding subfield SF1*a*, at the point at which luminance level varies from 7 to 8, as shown in FIG. 7(*b*), the value of bit varies from 0111 to 1000 to continue the emission of light, and the luminance level at the change point becomes about twice the luminance level 7 or 8, thereby causing a problem such as the rod disagreement with the variation of original signal.

(3b) Next, explanation will be made as to the case other than the case described in (3a). In this case, the signal output from the slow moving dynamic image corrector 16 will become a signal resulting from selecting the emission of light by the subfields corresponding to luminance level among the 4 subfields not including the subfield SF1*a* as described previously in (3). For instance, when the luminance level of input video signal is 8, signal is generated by selecting the emission of light from subfield SF4; when the luminance level is 7, signal generated by selecting the emission of light from subfields SF3, SF2 and SF1; when the luminance level is 3, signal generated by selecting the emission of light from subfields SF2 and SF1; when the luminance level is 8 resulting from variation from 7, signal generated by selecting the emission of light from subfield SF4, respectively.

In the embodiment described above, the rapid moving dynamic image corrector is explained with reference to the case where one frame is composed of 4 subfields SF4~SF1, whereas the slow moving dynamic image corrector is explained with reference to the case where one frame is composed of 4 subfields SF4~SF1 and a subfield SF1*a* adjacent to the subfield SF1, 5 subfields in total (i.e., 5 bits), but the present invention is not limited to this. For instance, the rapid moving dynamic image corrector is applicable to the case where one frame is composed of n number (n is any integer not less than 2) of subfields SFn~SF1, while the slow moving dynamic image corrector is applicable to the case where one frame is composed of n+1 number of subfields, i.e., n number of subfields SFn~SF1 plus one subfield SF1*a* in total, (case where the image is of gradation of $2^n$). Further, the latter can also be applied to the case where the subfield SF1*a* is omitted.

For instance, the slow moving dynamic image corrector is also applicable to the case where one frame is composed of 6 subfields in total (i.e., 6 bits), that is, 5 subfields (n=5), SF5~SF1, and 1 subfield SF1*a*, which is adjacent to SF1, (a case where the image to be displayed is of 32 gradations). In this case, the signal output from the slow moving dynamic image corrector 16, described previously in (3), becomes a signal to induce the emission of light from the subfields SF4, SF3, SF2, SF1 and SF1*a* only when the luminance level has varied to 16 from 15. Therefore, at the point at which the luminance level varies from 15 to 16, bit value varies from 011110 to 01111, and the emission of light will not continue, so that there is no substantial variation of luminance level thereby preventing degradation of picture quality.

In the above embodiment, the rapid moving dynamic image corrector is designed not only to select the emission of light from corresponding subfields among n number of subfields SFn~SF1 according to the luminance level of input video signal but also corrects the display positions of the n number of subfields of each frame of input video signal according to the value of the moving vector, but the present invention is not limited to this embodiment, and thus it is sufficient for the rapid moving dynamic image corrector to be any one which is capable of correcting input video signal for output by using proper correction means when the value of the moving vector detected by the moving vector detector is larger than the preset value S.

In the above embodiment, the slow moving dynamic image corrector is designed to select the light emitted from subfields SF(n−1), . . . SF1 and SF1*a* only when the luminance level of input video signal has varied from $2^{(n-1)}-1$ to $2^{(n-1)}$, and select the light emitted from corresponding subfields among n number of subfields SFn~SF1 not including subfield SF1*a* with respect to the luminance level other than that described previously, but the present invention is not limited to this embodiment, and thus it is sufficient for the slow moving dynamic image corrector to be any one which is capable of correcting for output the video signal by using proper dynamic image correction means when the value of the moving vector detected by the moving vector detector is smaller than the preset value S.

In the above embodiment, an explanation is made as to the case of display device using the PDP, but the present invention is not limited this, that is, the present invention is also applicable to the digital display device (e.g., display device using LCD).

INDUSTRIAL AVAILABILITY

As described in the foregoing, the present invention is designed to provide an optimum dynamic image correction for both the rapid moving part and slow moving part of dynamic image when applied to a display device (e.g., display devices using PDP or LCD), wherein one frame is divided into a plurality of subfields on time-sharing basis, and the image of multigradation is produced by having subfields emit light according to the luminance level of input video signal.

What is claimed is:

1. A dynamic image correction method for display device, the display device having one frame divided into a plurality of subfields for producing multigradation image by having the subfields emit light according to the luminance level of input video signal, wherein the moving vector of a block during one frame or during a plurality of frames is detected on the basis of the input video signal, and the signal obtained by correcting the input video signal by either the rapid moving dynamic image correction means or the slow moving dynamic image correction means is selectively output to the display device depending on whether the value of the detected moving vector is larger or smaller than the preset value S.

2. A dynamic image correction method for display device according to claim 1, wherein the rapid moving dynamic image correction means not only selects the light emitted from corresponding subfields among n number of subfields SFn~SF1 according to the luminance level of input video signal, the n number of subfields constituting one frame and having luminance ratios of $2^{(n-1)}$ (n=any integer not less than 2) through $2^{0(=n-n)}$, but also corrects display positions of the n number of subfields SFn~SF1, which constitute each frame of the input video signal, depending on the value of the detected moving vector, while the slow moving dynamic image correction means selects the light emitted from subfields SF(n−1)~SF1 and SF1*a* only when the luminance level of input video signal has varied from $2^{(n-l)}-1$ to $2^{(n-1)}$, the n number of subfields SFn~SF1 and SF1*a*, the SF1*a* being adjacent to SF1, constituting one frame and having Luminance ratios of $2^{(n-1)}$ through $2^{0(n-n)}$, and also selects the light emitted from corresponding subfields among n number of subfields SFn~SF1 not including the subfield SF1*a* with respect to the luminance levels other than those described above.

3. A dynamic image correction circuit of display device, the display device having one frame divided into a plurality of subfields on time-sharing basis to produce multigradation image by having corresponding subfields emit light according to the luminance level of input video signal, comprising a moving vector detector for detecting the moving vector of a block during one frame or during a plurality of frames according to the input video signal, a rapid moving dynamic image corrector for correcting the input video signal for output by using a proper dynamic image correction means when the detected value of moving vector is larger than preset value S, a slow moving dynamic image corrector for correcting the input video signal by using a proper dynamic image correction means when the detected value of moving vector is smaller than the preset value S and a discriminating selector for selectively output the signal output from the rapid moving dynamic image corrector or the signal output from the slow moving dynamic image corrector depending on whether the value of the detected moving vector is larger or smaller than the preset value S.

4. A dynamic image correction circuit for display device according to claim 3, wherein the rapid moving dynamic image corrector not only selects the light emitted from corresponding subfields among n number of subfields SFn~SF1 according to the luminance level of input video signal, the n number of subfields SFn~SF1 having luminance ratios of $2^{(n-1)}$ (n=any integer not less than 2) through $2^{0(=n-n)}$ and constituting one frame, but also corrects the display position of the n number of subfields SFn~SF1, which constitute each frame of the video signal, depending on the value of detected moving vector, while the slow moving dynamic image corrector selects the light emitted from corresponding subfields among n number of subfields SFn~SF1 and subfield SF1*a* only when the luminance level of input video signal has varied from $2^{(n-1)}-1$ to $2^{(n-1)}$, the subfields SFn~SF1 and subfield SF1*a* having luminance ratios of $2^{(n-1)}$ through $2^{0(=n-n)}$ and constituting one frame, and also selects the light emitted from corresponding subfields among n number of subfields SFn~SF1 not including subfield SF1*a* with respect to the luminance levels other than those described above.

* * * * *